US012467726B2

(12) United States Patent
Perry

(10) Patent No.: US 12,467,726 B2
(45) Date of Patent: Nov. 11, 2025

(54) MULTI-FUNCTIONAL BROADHEAD FIXED AND MECHANICAL

(71) Applicant: Evolution Outdoors LLC, Goodyear, AZ (US)

(72) Inventor: Dale Wayne Perry, Goodyear, AZ (US)

(73) Assignee: Evolution Outdoors LLC, Goodyear, AZ (US)

( * ) Notice: Subject to any disclaimer, the term of this patent is extended or adjusted under 35 U.S.C. 154(b) by 0 days.

(21) Appl. No.: 18/152,469

(22) Filed: Jan. 10, 2023

(65) Prior Publication Data

US 2025/0035414 A1 Jan. 30, 2025

Related U.S. Application Data

(63) Continuation of application No. 17/147,263, filed on Jan. 12, 2021, now Pat. No. 11,549,790, which is a continuation of application No. 16/723,681, filed on Dec. 20, 2019, now Pat. No. 10,890,421.

(60) Provisional application No. 62/784,485, filed on Dec. 23, 2018.

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS

| | | | |
|---|---|---|---|
| 3,036,395 | A | 5/1962 | Nelson |
| 3,138,383 | A | 6/1964 | McKinzie |
| 4,036,499 | A | 7/1977 | Sherwin |
| 4,901,467 | A | 2/1990 | Stolpe |
| 5,083,798 | A | 1/1992 | Massey |
| 5,102,147 | A | 4/1992 | Szeluga |
| 5,458,341 | A | 10/1995 | Forrest et al. |
| 5,564,713 | A | 10/1996 | Mizek et al. |
| 5,803,844 | A | 9/1998 | Anderson |
| 5,820,498 | A | 10/1998 | Maleski |
| 5,941,784 | A | 8/1999 | Mizek |
| 6,015,357 | A | 1/2000 | Rizza |
| 6,171,206 | B1 | 1/2001 | Liechty, II |
| 6,200,237 | B1 | 3/2001 | Barrie |
| 6,217,467 | B1 | 4/2001 | Maleski |
| 6,258,000 | B1 | 7/2001 | Liechty, II |
| 6,283,880 | B1 | 9/2001 | Barrie |
| 6,287,223 | B1 | 9/2001 | Liechty, II |
| 6,287,224 | B1 | 9/2001 | Liechty, II |
| 6,554,727 | B1 | 4/2003 | Armstrong et al. |
| 6,663,518 | B1 | 12/2003 | Kuhn |
| 6,669,586 | B2 | 12/2003 | Barrie et al. |
| 6,789,346 | B1 | 9/2004 | Holler |
| 6,793,596 | B1 | 9/2004 | Sullivan et al. |
| 6,910,979 | B2 | 6/2005 | Barrie et al. |
| 6,935,976 | B1 | 8/2005 | Grace, Jr. et al. |
| 7,011,589 | B2 | 3/2006 | Davis |
| 7,025,697 | B2 | 4/2006 | Mizek et al. |

(Continued)

*Primary Examiner* — John A Ricci

(57) ABSTRACT

Disclosed herein is a multifunctional broadhead and universal ferrule for an archery arrow that has both mechanical and fixed configurations. The disclosure is directed to multifunctional mechanical arrow broadheads that deploy blades upon contact with a target and the ability to transition to a broadhead configured with the blades in a deployed and fixed position prior to target contact.

22 Claims, 3 Drawing Sheets

(56) References Cited

U.S. PATENT DOCUMENTS

| | | | |
|---|---|---|---|
| 7,226,375 | B1 | 6/2007 | Sanford |
| 7,234,220 | B1 | 6/2007 | Grace, Jr. |
| 7,311,621 | B2 | 12/2007 | Sullivan et al. |
| 7,314,419 | B2 | 1/2008 | Grace et al. |
| RE40,273 | E | 4/2008 | Grace, Jr. et al. |
| 7,377,869 | B2 | 5/2008 | Wohlfeil et al. |
| 7,422,533 | B1 | 9/2008 | Johnson |
| D583,897 | S | 12/2008 | Ward |
| 7,571,564 | B2 | 8/2009 | Sullivan |
| 7,682,271 | B2 | 3/2010 | Rager |
| 7,713,151 | B2 | 5/2010 | Fulton |
| 7,771,298 | B2 | 8/2010 | Pulkrabek |
| 7,942,765 | B2 | 5/2011 | Odabachian et al. |
| 8,016,704 | B1 | 9/2011 | Vandewater |
| 8,029,392 | B2 | 10/2011 | Bolen, III |
| 8,043,177 | B2 | 10/2011 | Flanagan |
| 8,052,554 | B2 | 11/2011 | Lee |
| 8,062,155 | B2 | 11/2011 | Butcher |
| 8,113,973 | B1 | 2/2012 | Lee |
| 8,128,521 | B1 | 3/2012 | Ulmer |
| 8,147,360 | B2 | 4/2012 | Simo et al. |
| 8,147,361 | B1 | 4/2012 | Weaver |
| 8,182,378 | B1 | 5/2012 | Futtere |
| D664,230 | S | 7/2012 | Musacchia, Jr. |
| 8,210,971 | B1 | 7/2012 | Fulton |
| 8,272,979 | B1 | 9/2012 | Cooper |
| 8,328,667 | B2 | 12/2012 | Adams et al. |
| RE44,144 | E | 4/2013 | Barrie et al. |
| 8,414,432 | B1 | 4/2013 | Hand |
| 8,449,415 | B2 | 5/2013 | Grace |
| 8,449,416 | B2 | 5/2013 | Grace et al. |
| RE44,474 | E | 9/2013 | Vandewater |
| 8,545,349 | B1 | 10/2013 | Budris et al. |
| 8,663,041 | B1 | 3/2014 | Gryspeerd |
| 8,684,869 | B1 | 4/2014 | Perry |
| D704,787 | S | 5/2014 | Gryspeerd |
| 8,734,276 | B2 | 5/2014 | Laurienzo et al. |
| 8,758,176 | B2 | 6/2014 | Pedersen |
| D710,962 | S | 8/2014 | Pedersen |
| D711,489 | S | 8/2014 | Pedersen |
| 8,894,519 | B2 | 11/2014 | Young |
| 8,905,874 | B2 | 12/2014 | Sullivan et al. |
| 8,911,310 | B2 | 12/2014 | Lee |
| 8,911,311 | B1 | 12/2014 | Mizek et al. |
| 8,915,808 | B2 | 12/2014 | Powell |
| 8,926,457 | B2 | 1/2015 | Treto |
| 8,986,141 | B2 | 3/2015 | Pedersen |
| D730,471 | S | 5/2015 | Pedersen |
| 9,028,349 | B2 | 5/2015 | Budris et al. |
| 9,046,331 | B1 | 6/2015 | Mallo |
| 9,068,806 | B2 | 6/2015 | Pedersen |
| 9,091,515 | B1 | 7/2015 | Lee |
| 9,109,863 | B2 | 8/2015 | York |
| 9,115,962 | B1 | 8/2015 | Weaver |
| 9,121,676 | B1 | 9/2015 | Coalson et al. |
| 9,170,078 | B2 | 10/2015 | Pedersen |
| 9,194,673 | B1 | 11/2015 | Lee |
| 9,228,813 | B1 | 1/2016 | Pedersen |
| 9,267,773 | B2 | 2/2016 | Mizek |
| D751,163 | S | 3/2016 | Ohlau |
| 9,303,962 | B1 | 4/2016 | Burnworth et al. |
| 9,303,963 | B1 | 4/2016 | Ford |
| 9,329,005 | B2 | 5/2016 | Meier et al. |
| 9,329,006 | B1 | 5/2016 | Hansen |
| 9,341,450 | B1 | 5/2016 | Lin |
| 9,341,451 | B1 | 5/2016 | Campbell et al. |
| 9,347,751 | B2 | 5/2016 | Hollars |
| 9,372,056 | B2 | 6/2016 | Sullivan et al. |
| D765,208 | S | 8/2016 | Loa |
| 9,404,722 | B2 | 8/2016 | Pedersen |
| D774,615 | S | 12/2016 | Pedersen |
| 9,526,234 | B2 | 12/2016 | Harshberger |
| D776,782 | S | 1/2017 | Pedersen |
| 9,683,813 | B2 | 6/2017 | Beckman |
| 9,750,995 | B2 | 9/2017 | Nally |
| 9,772,170 | B1 | 9/2017 | Lathrop |
| 9,803,962 | B2 | 10/2017 | Hahn |
| 9,803,963 | B1 | 10/2017 | Huang |
| 9,857,152 | B2 | 1/2018 | Franco, Sr. |
| 9,857,153 | B1 | 1/2018 | Redline |
| 9,879,955 | B2 | 1/2018 | Rowley |
| 9,903,693 | B2 | 2/2018 | Salvino et al. |
| 9,945,647 | B2 | 4/2018 | Pugliese et al. |
| 9,945,648 | B2 | 4/2018 | Grace |
| 9,982,974 | B1 | 5/2018 | McGaha |
| 10,012,487 | B2 | 7/2018 | Isaacson |
| 10,030,949 | B1 | 7/2018 | Grace |
| 10,034,464 | B2 | 7/2018 | Sullivan |
| 10,041,772 | B1 | 8/2018 | Sullivan |
| 10,066,912 | B2 | 9/2018 | Grace |
| 10,077,975 | B2 | 9/2018 | Haas |
| 10,082,373 | B2 | 9/2018 | Romero |
| 10,168,130 | B1 | 1/2019 | Wang |
| 10,180,312 | B2 | 1/2019 | Asbill |
| D847,290 | S | 4/2019 | Betty |
| D847,937 | S | 5/2019 | Isringhausen |
| D849,873 | S | 5/2019 | Betty |
| 10,281,250 | B2 | 5/2019 | Beck et al. |
| 10,288,392 | B2 | 5/2019 | Haas |
| 10,295,316 | B2 | 5/2019 | Wukie |
| 10,295,321 | B2 | 5/2019 | Braden et al. |
| 10,309,754 | B2 | 6/2019 | Pugliese et al. |
| 10,337,843 | B1 | 7/2019 | Kinzer |
| 10,352,665 | B2 | 7/2019 | Haas |
| 10,352,667 | B2 | 7/2019 | Salvino |
| 10,393,485 | B1 | 8/2019 | Painter et al. |
| 10,415,940 | B2 | 9/2019 | Sullivan et al. |
| D865,102 | S | 10/2019 | Haas |
| 10,436,556 | B1 | 10/2019 | Ohlau |
| 10,458,763 | B2 | 10/2019 | Blosser et al. |
| 10,458,767 | B2 | 10/2019 | Buchanan |
| D870,231 | S | 12/2019 | Haas |
| 10,514,238 | B2 | 12/2019 | Razmus et al. |
| 10,591,262 | B1 | 3/2020 | Osborn et al. |
| 10,598,469 | B2 | 3/2020 | Lankford |
| 10,598,470 | B1 | 3/2020 | Sanford |
| 10,627,197 | B2 | 4/2020 | Kozlik et al. |
| 10,746,514 | B1 | 8/2020 | Stacy |
| 10,809,044 | B2 | 10/2020 | Perry |
| 10,823,537 | B2 | 11/2020 | Jones |
| 10,837,742 | B2 | 11/2020 | Romero |
| 10,837,743 | B1 | 11/2020 | Beam et al. |
| 10,921,102 | B1 | 2/2021 | Albanese |
| 11,002,522 | B1 | 5/2021 | Tagget et al. |
| 11,033,011 | B2 | 6/2021 | Isringhausen |
| D924,351 | S | 7/2021 | Derus et al. |
| 11,054,228 | B2 | 7/2021 | Romero |
| 11,085,743 | B2 | 8/2021 | Buchanan |
| 11,105,594 | B2 | 8/2021 | Decker |
| 11,125,542 | B2 | 9/2021 | Motz |
| 11,137,235 | B2 | 10/2021 | Fischer |
| 11,137,236 | B2 | 10/2021 | Randall et al. |
| 2002/0151394 | A1 | 10/2002 | Arasmith |
| 2004/0048704 | A1 | 3/2004 | Arasmith |
| 2012/0040787 | A1 | 2/2012 | Ulmer |
| 2012/0178560 | A1 | 7/2012 | Grace et al. |
| 2013/0102425 | A1 | 4/2013 | Mizek et al. |
| 2013/0102426 | A1 | 4/2013 | Mizek et al. |
| 2017/0131073 | A1 | 5/2017 | Buchanan |
| 2018/0292190 | A1 | 10/2018 | Buchanan |

MULTI-FUNCTIONAL BROADHEAD FIXED AND MECHANICAL

CROSS REFERENCE TO RELATED APPLICATION

This application is a continuation of U.S. application Ser. No. 17/147,263, filed Jan. 12, 2021, now U.S. Pat. No. 11,549,790, which is a continuation of U.S. application Ser. No. 16/723,681, filed Dec. 20, 2019, now U.S. Pat. No. 10,890,421, which claims benefit to U.S. Provisional Application No. 62/784,485 filed on Dec. 23, 2018. The above applications is incorporated herein by reference.

FIELD OF THE INVENTION

The present disclosure generally relates to a multifunctional broadhead for an archery arrow that has both a mechanical and fixed configuration. The disclosure is also directed to multifunctional mechanical arrow broadheads that deploy blades upon contact with a target with the ability to transition to a broadhead configured with the blades in a deployed and fixed position prior to target contact. Mechanical broadheads typically include blades that remain in a stowed and aerodynamic position during the time of flight of an arrow. Upon contact with a target, the blades deploy to an open or extended position. The present disclosure is directed to universal/multifunctional broadheads that are configured to transition from a mechanical blade configuration to a fixed blade configuration and back again.

BACKGROUND

An arrow launched from a bow typically includes a shaft, stabilizers or fins known as fletchings and an arrowhead. Various types of arrowheads exist such as a broadhead used by hunters. A broadhead typically includes two to four sharp cutting-blades to injure or kill a target. Bow hunters typically use two main types of broadheads and include fixed-blade broadheads and mechanical broadheads. Fixed-blade broadheads maintain blades in a rigid, extended, and immovable position, and a mechanical broadhead deploys its blades from a retracted or stored position, to an extended or deployed position upon contact with the target. In most cases, the arrow with the mechanical broadhead flies better because it is more aerodynamic due to the retracted blades, but has less penetration compared to the fixed-blade broadhead since the mechanical broadhead uses some of the kinetic energy in the arrow to deploy its blades upon target impact.

Thus, all broadheads fall under two classifications as recognized by the archery industry: 1) fixed: and 2) mechanical. Hybrid variations exist, but all hybrids fall in the mechanical classification according to state hunting regulations. The present disclosure describes a universal or multipurpose broadhead with a universal ferrule (i.e., broadhead body) with the ability to transition back and forth between a mechanical mode and a fixed mode, according to the user's requirements and desires, while still maintaining superior dynamic flight characteristics across all modes. And maintaining the same grain weight. One skilled in the art of designing and manufacturing of broadheads will understand that the weight variations can fluctuate with the material batches and machining practices, but within the accepted weight tolerances and within industry standards.

Historically, bow hunters have chosen either fixed or mechanical based upon mandated state hunting regulations.

However, using a mechanical broadhead for certain game species, and using a fixed broadhead for other game species results in different dynamic flight characteristics due to vastly different broadheads with a different ferrule designs. Such a limitation results in unpredictable accuracy and poor training habits. The broadhead disclosed herein, however, minimizes such shortfalls by allowing an archer to easily transition between interchangeable mechanical blades and fixed blades. Such a capability also provides a flexible broadhead that is legal and in accordance with the hunting regulations of all 50 states.

Currently, no such multifunctional broadhead exists to allow an archer to use a broadhead with a single universal ferrule that can transition back and forth between fixed and mechanical configurations. Most broadhead manufacturers understand that the ferrule is typically the strongest part of the broadhead. Thus, replacement blades are sold, but only for configurations that the broadhead was originally available. The broadhead, blade configurations, and related ferrule disclosed herein provide an archer with greater cost savings, enhanced accuracy in both fixed and mechanical broadhead configurations that are suitable for a wide range of hunting needs.

SUMMARY OF THE INVENTION

This disclosure generally relates to multifunctional broadheads and universal ferrules for an archery arrow that have both mechanical and fixed configurations. The disclosure is directed to multifunctional mechanical arrow broadheads that deploy blades upon contact with a target and have the ability to transition to a broadhead configured with the blades in a deployed and fixed position prior to target contact.

In accordance with an exemplary illustrative embodiment, a multifunctional arrow broadhead is disclosed comprising a ferrule that includes a plurality of slots and at least one screw/pin. In some examples, the broadhead may include at least two blades that are configured to engage the plurality of slots in the ferrule. In other examples, the screw/pin may secure the blades to the ferrule. In yet other examples, the multifunctional broadhead may include a base and the blades may be further configured to function in a first mode and the two blades may also be further configured to function in a second mode. In still other examples, the first and second modes may be user selected.

In other examples, the first mode may be a fixed blade configuration in which the blades may be extended in a deployed position. In some examples, the second mode may be a mechanical configuration in which the blades may be further configured in a retracted position throughout an arrow time of flight and the blades may deploy to an extended position upon impacting a target. In yet another example, the blades may be configured to pivot from the retracted position to the extended position on an axis of the screw/pin and the blades may extend through the plurality of slots in the ferrule. In another example, the ferrule may include a third blade. In still other examples, the ferrule may include a fourth blade.

In certain examples, the ferrule may further include a media hole in which the blades may be held in the retracted position by insertion of a media into the media hole forming a friction fit. Upon target impact, the blades may deploy into the extended position. In other examples, the media may be a nylon, a polymer blend, or combination thereof.

In still other examples, the cutting diameter of the blades may be at least 2 inches when the blades are extended in the first or second modes. In other examples, the blades may form an angle from about 90 to 120 degrees when the blades are in the extended position. In some examples, at least two thirds of the blades may be contained within the ferrule when the blades are in the second mode. In another example, the ferrule may be aluminum, carbon, steel, or titanium. In yet another example, the base may be threaded and configured to removably engage an arrow shaft or an arrow insert. In other examples, the blades may have a thickness from 0.020 inches to 0.085 inches. In certain examples, the ferrule may have a length of at least 1.25 inches and a diameter of at least 0.220 inches. In another example, the ferrule may further include a sharpened tip or a fixed blade. In still other examples, the weight of the broadhead may be between 115 and 125 grains.

In accordance with another embodiment, a method of forming a multifunctional arrow broadhead is disclosed comprising forming a ferrule that may include a plurality of slots and at least one screw/pin. In other examples, the method may include forming at least two blades that may be configured to engage the plurality of slots and the screw/pin may secure the blades to the ferrule. In yet another example, the method may include forming a base that may be threaded and may be configured to removably engage an arrow shaft or an arrow insert. In other examples, the blades may be formed configured to function in a first mode. In other examples, the blades may be formed configured to also function in a second mode. In some examples, the first and second modes may be user selected. In certain examples, the first mode may be a fixed blade configuration with the blades extended in a deployed position. In still other examples, the second mode may be a mechanical configuration in which the blades may be further configured in a retracted position throughout an arrow time of flight and the blades may deploy to an extended position upon a target impact.

In accordance with still another embodiment, an multifunctional arrow broadhead system is disclosed comprising a ferrule that may include a plurality of slots and at least one screw/pin, a plurality of blades that may be configured to engage the plurality of slots, and the screw/pin may secure the blades to the ferrule, and the system may include a base. In certain examples, the blades may be further configured to function in a first mode that may be a fixed blade configuration with the blades extended in a deployed position. In other examples, the blades may be further configured to function in a second mode that may be a mechanical configuration with the blades further configured in a retracted position throughout an arrow time of flight with the blades further configured to deploy to an extended position upon a target impact. In another example, the first and second modes may be user selected. In still other examples, the plurality of blades may be interchangeable with each other.

The advantages and features of novelty characterizing various aspects of the invention are pointed out with particularity in the appended claims. To gain an improved understanding of the advantages and features of novelty, however, reference may be made to the following descriptive matter and accompanying drawings that describe and illustrate various embodiments and concepts related to the aspects of the invention.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

Figure 1:
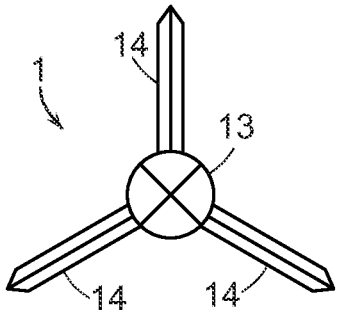
FIG. 1 illustrates a top front-view of a three blade broadhead in the fixed configuration as disclosed herein.

Further, it is to be understood that the drawings may represent the scale of different components of one single embodiment: however, the disclosed embodiments are not limited to that particular scale.

DETAILED DESCRIPTION

The present disclosure is directed to a multifunctional broadhead design that allows a user to convert the broadhead to a mechanical configuration or a fixed configuration broadhead by only changing the blades while using the same ferrule. Such a capability allows the user to comply with various hunting regulations and laws. The ability to swap between a mechanical and fixed configuration also allows a user to maximize the effectiveness of the broadhead based upon the particular game. As disclosed herein, the unique ferrule is designed in a way that the user can easily change from a mechanical blade to a fixed blade using simple tools. For example, by removing a single screw/pin the user may configure the broadhead in whichever configuration is required.

As disclosed herein, the components of the broadhead work in unison and each component includes is interchangeable in various aspects. In the various embodiments disclosed herein, the mechanical and fixed single blade, two blades, three blades, and four blades may be designed to be replaced by a fixed blade or blades, and held securely in place. Accordingly, the unique ferrule design disclosed herein is the intricate component having the multifunctional properties to facilitate changes between fixed and mechanical configurations.

As disclosed herein, the design characteristics of the ferrule allow the mechanical and fixed blades to be removed and replaced with the opposite blade configuration using all or part of the existing configuration and components originally manufactured in the ferrule. For example, the user may easily transition between fixed and mechanical configurations of the broadhead design by removing pins and/or screws to remove one set of blades and insert the other set of blades while securing them with the same pins and/or screws.

The ferrule body disclosed herein may have a slot(s) or opening(s) of a specific size allowing one or multiple blades of a specific thickness to pivot from the ferrule body creating the mechanical blade movement. The mechanical blades may be held in place by various means such as a spring or other means to form a friction fit allowing the blades to deploy to an open or expanded position upon target contact. The retention system that maintains the blades in the retracted position is critical to the mechanical broadhead design. A modern example of a mechanical blade includes U.S. patent application Ser. No. 16/659,139, Mechanical Blade retention System for Archery Broadhead filed on Oct. 21, 2019, and incorporated herein by reference in its entirety for all purposes. As also disclosed herein, the ferrule is configured to engage mechanical blades that are interchangeable with fixed blades. As disclosed herein, the slot(s) or opening(s) of the ferrule are configured to house the mechanical blades and are also configured to secure fixed blades.

The ferrule body disclosed herein may have a slot(s) or opening(s) of a specific size allowing one or multiple blades of a specific thickness to pivot from the ferrule body creating the mechanical blade movement. The mechanical blades may be held in place by various means such as a spring or other means to form a friction fit allowing the blades to deploy to an open or expanded position upon target contact. The retention system that maintains the blades in the retracted position is critical to the mechanical broadhead design. A modern example of a mechanical blade includes U.S. patent application Ser. No. 16/659,139, Mechanical Blade retention System for Archery Broadhead filed on Oct. 21, 2019, and incorporated herein by reference in its entirety for all purposes. As also disclosed herein, the ferrule is configured to engage mechanical blades that are interchangeable with fixed blades. As disclosed herein, the slot(s) or opening(s) of the ferrule are configured to house the mechanical blades and are also configured to secure fixed blades.

In other examples, the blades may further include a notch in an end of the blades, in which the notches of each blade align with each other when the blades are in the retracted position. In still other examples, the blades are held in the retracted position by insertion of a media into the media hole. The media is forced into the aligned notches by the set screw, and the media forces the blades to remain in the retracted position by a friction fit from the force of the media. In yet another example, upon impacting the target, the blades extend into the deployed position by forcing the media from the blade notches and permitting the blades to extend into the deployed position. In some examples, the media may be nylon, a polymer blend, wood, clay, a gel, a paste, a soft metal, or a combination thereof.

Figure 2:
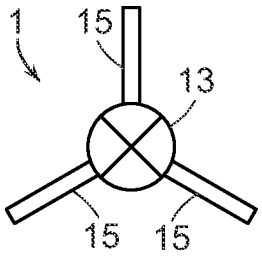
FIG. 2 illustrates a top front-view of a three blade broadhead in the mechanical configuration as disclosed herein.
Figure 3:
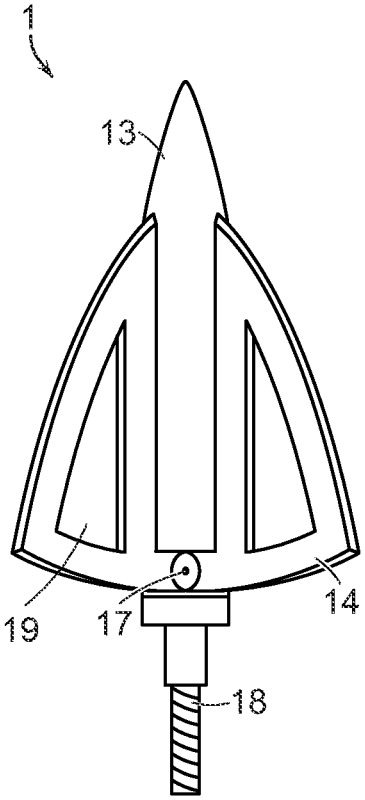
FIG. 3 illustrates a side perspective-view of the three blade broadhead shown in FIG. 1 in the fixed configuration and as disclosed herein.

As shown in FIGS. 1-4, the multifunctional broadhead 1 may include a ferrule 13, with at least three blades 14 or 15 configured to engage three slots formed in the ferrule 13. FIG. 1 illustrates a top front-view of the three blade broadhead 1 with the fixed blades 14 in the fixed and extended configuration. FIG. 3 illustrates the side perspective-view of the three blade broadhead 1 shown in FIG. 1 with the blades 14 in the fixed configuration. The multifunctional broadhead 1 may include a screw or pin 17 at the lower portion of the ferrule. The screw or pin 17 may be configured to secure the blade or plurality of blades 14 and/or 15 to the ferrule. The screw or pin 17 may be configured to secure the mechanical and/or fixed blade system to the ferrule and may be interchangeable between blades. In certain examples, the blades 14 and/or 15 may include vents 19. In some examples, the blades 14 and/or 15 may not include vents 19. In still other examples, each blade 14 and/or 15 may include a plurality of vents 19. Vents 19 may be substantially triangular shaped. In other examples, vents 19 may be substantially shaped like a square, circle, rectangle, polygon, parallelogram, star, etc. According to certain aspects, the user removes the pin or screw 17 with a common tool and the mechanical and or fixed blades may be removed and/or secured to the ferrule 13. The aft portion of the ferrule 13 may include a lower threaded portion 18 and may be adapted to attach to an arrow shaft. In alternative embodiments, the lower portion 18 may or may not include threads and may be attached to an arrow or cross-bow bolt by other means known to one of skill in the art, such as an adhesive, friction fit, screw; or bolt and nut, etc.

Figure 4:
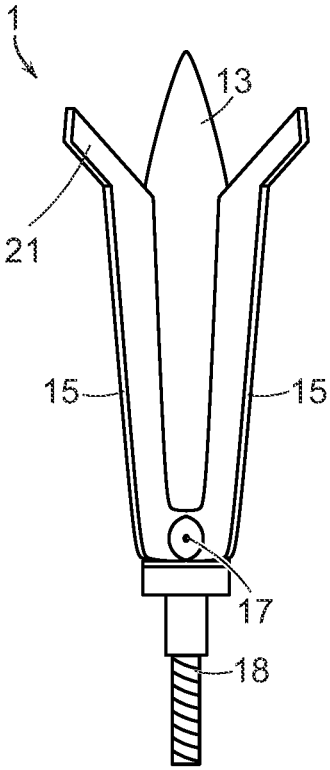
FIG. 4 illustrates a side perspective-view of the three blade broadhead shown in FIG. 2 in the mechanical configuration and as disclosed herein.

FIG. 2 illustrates another top front-view of a three blade broadhead 1 in the mechanical configuration with the mechanical blades 15 secured in the retracted position. FIG. 4 illustrates a side perspective-view of the three blade broadhead 1 shown in FIG. 2 in the mechanical configuration. Upon target impact, the blades 15 of broadhead 1 may be configured to deploy to an extended position. In some configurations, the mechanical blades 15 may rotate about the axis of screw/pins 17 as shown in FIG. 4. In some configurations, the broadhead 1 may include at least one, two, or three screw/pins 17. The blades 15, as shown in FIGS. 1 and 2, may be oriented at a 120 degree angle between each blade. The blades 15, as shown in FIG. 4, may include blade tips 21 that bend in a 20-45 degree angle away from the tip of the ferrule 13 when the blades 15 are in the retracted position. In certain examples, the blade tips 21 may bend away from the ferrule 13 tip at an angle of at least 5, 10, 20, 25, 30, 35, 40, 45, 50, 55, 60, 65, 70, 75, 80, 85, or 90 degrees. This particular blade configuration may assist the blades in deploying to an expanded configuration upon target impact.

As shown in FIG. 3, the angle of the fixed blades 14 (and/or mechanical blades 14 in the extended position) may form at least a 10, 15, 20, 25, 30, 35, 40, 45, 50, 55, 60, 65, 70, 75, 80, 85, or 90 degree angle as measured from the longitudinal axis of the ferrule and arrow shaft. In still another example, the blades 15 of the broadhead 1 may form an angle in the deployed or open position of about 90 to 120 degrees when the blades are extended in the deployed position as measured from the longitudinal axis of the ferrule 13 and arrow shaft to the tip of the blade 15. In some examples, the angle of the blades 15 may form a 90 degree angle as measured from the longitudinal axis of the ferrule 13 and arrow shaft to the tip of the blade 15. In other examples, the angle of the blades 15 may form a 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 degree angle as measured from the longitudinal axis of the ferrule 13 and arrow shaft.

Figure 5:
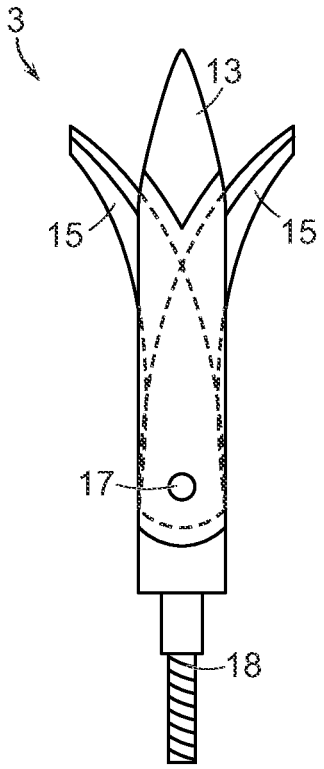
FIG. 5 illustrates a side perspective-view of a two blade broadhead in the mechanical configuration as disclosed herein.
Figure 6:
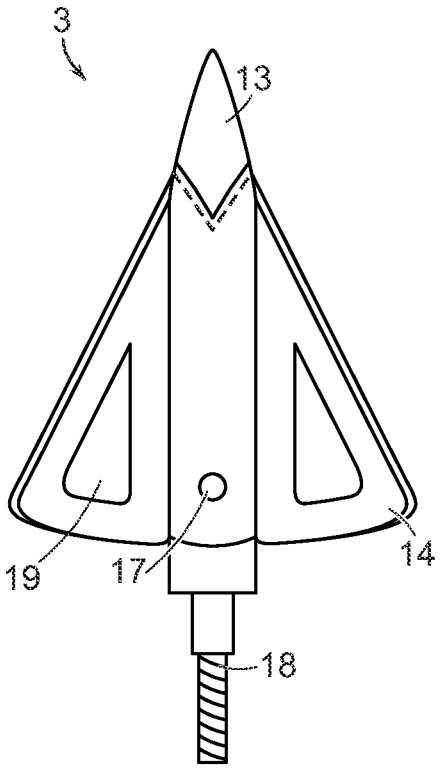
FIG. 6 illustrates a side perspective-view of a two blade broadhead in the fixed configuration as disclosed herein.
Figure 7:
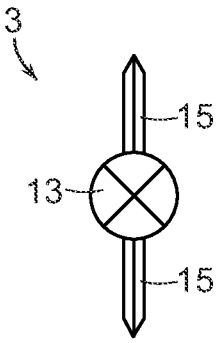
FIG. 7 illustrates a top front-view of the two blade broadhead shown in FIG. 5 in the mechanical configuration and as disclosed herein.
Figure 8:
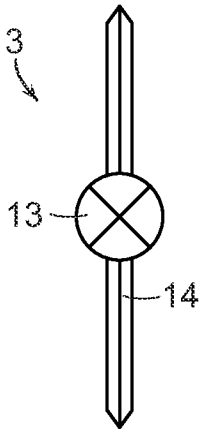
FIG. 8 illustrates a top front-view of the two blade broadhead shown in FIG. 6 in the mechanical configuration and as disclosed herein.

In an alternative embodiment, as shown in FIGS. 5-8, the multifunctional broadhead 3 may include a ferrule 13, with at least one fixed blade 14 or at least one or two mechanical blades 15 configured to engage at least two slots formed in the ferrule 13. FIG. 8 illustrates a top front-view of the two or single blade broadhead 3 with the fixed blades 14 in the fixed and extended configuration. FIG. 6 illustrates the side perspective-view of the two or single blade broadhead 3 with the blades 14 in the fixed configuration. The multifunctional broadhead 3 may also include a screw or pin 17 at the lower portion of the ferrule. The screw or pin 17 may be configured to secure the blade or plurality of blades 14 and/or 15 to the ferrule 13. As described above, the screw or pin 17 may be configured to secure the mechanical and/or fixed blade system to the ferrule and may be interchangeable between blades. In some configurations, the broadhead 3 may include at least one or two screw/pins 17. In certain examples, the blades 14 and/or 15 may include vents 19. In some examples, the blades 14 and/or 15 may not include vents 19. In still other examples, each blade 14 and/or 15 may include a plurality of vents 19. Vents 19 may be substantially triangular shaped. In other examples, vents 19 may be substantially shaped like a square, circle, rectangle, polygon, parallelogram, star, etc. Again, the user may remove the pin or screw 17 of the broadhead 3 with a common tool and the mechanical and or fixed blades may be removed and/or secured to the ferrule 13. The aft portion of the ferrule 13 may include a lower threaded portion 18 and may be adapted to attach to an arrow shaft. In alternative embodiments, the lower portion 18 may or may not include threads and may be attached to an arrow or cross-bow bolt by other means known to one of skill in the art, such as an adhesive, friction fit, screw, or bolt and nut, etc.

FIG. 5 illustrates a side perspective-view of the two blade broadhead 3. Upon target impact, the mechanical blade or blades 15 of broadhead 3 may be configured to deploy to an extended position. In some configurations, the mechanical blades 15 may rotate about the axis of screw/pin 17 as shown in FIG. 5. The blades 14 and 15, as shown in FIGS. 7 and 8, may be oriented at a 180 degree angle between each blade. The blades 14, as shown in FIG. 6, may include an angle that may form at least a 10, 15, 20, 25, 30, 35, 40, 45, 50, 55, 60, 65, 70, 75, 80, 85, or 90 degree angle as measured from the longitudinal axis of the ferrule and arrow shaft.

In another example, the blades 15 of the broadhead 3 may form an angle in the deployed or open position of about 90 to 120 degrees when the blades are extended in the deployed position as measured from the longitudinal axis of the ferrule 13 and arrow shaft to the tip of the blade 15. In some examples, the angle of the blades 15 may form a 90 degree angle as measured from the longitudinal axis of the ferrule 13 and arrow shaft to the tip of the blade 15. In other examples, the angle of the blades 15 may form a 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 degree angle as measured from the longitudinal axis of the ferrule 13 and arrow shaft.

Figure 9:
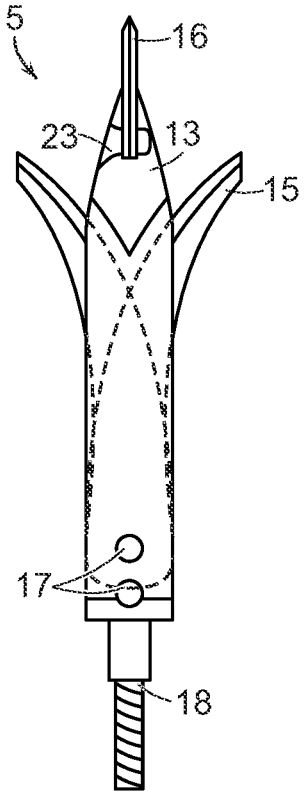
FIG. 9 illustrates a side perspective-view of a four blade broadhead or multifunctional broadhead in the mechanical configuration as disclosed herein.
Figure 10:
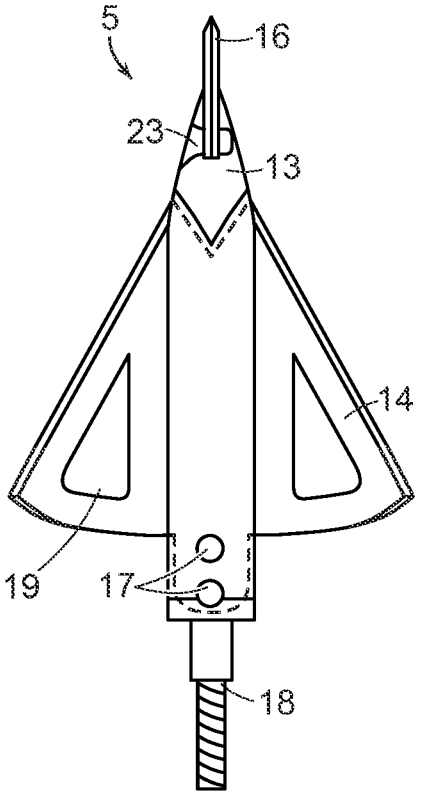
FIG. 10 illustrates a side perspective-view of a four blade broadhead or multifunctional broadhead in the fixed configuration as disclosed herein.
Figure 11:
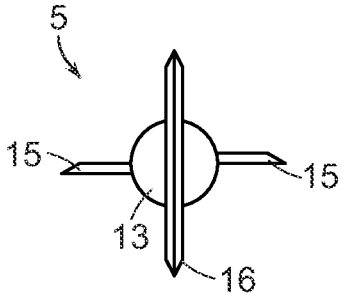
FIG. 11 illustrates a top front-view of the four blade broadhead shown in FIG. 9 in the mechanical configuration and as disclosed herein.
Figure 12:
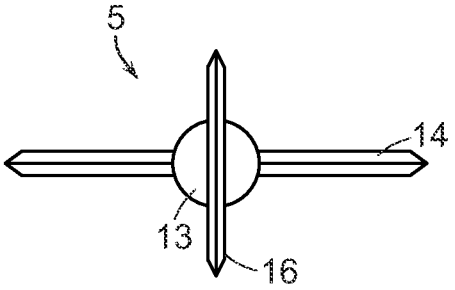
FIG. 12 illustrates a top front-view of the four blade broadhead shown in FIG. 10 in the mechanical configuration and as disclosed herein.

In another embodiment, as shown in FIGS. 9-12, the multifunctional broadhead 5 may include a ferrule 13, with at least two fixed blades 14 or at least one or two mechanical blades 15 configured to engage at least two slots formed in the ferrule 13. In other examples, the ferrule may include a slot configured to engage a fixed blade 16 secured to the ferrule 13 by screw, pin, or grommet 23. FIG. 10 illustrates the side perspective-view of the broadhead 5 with the blades 14 and 16 in the fixed configuration. FIG. 12 illustrates a top front-view of the broadhead 5 with at least two fixed blades 14 and 16 in the fixed and extended configuration. The multifunctional broadhead 5 may also include a first and second screw or pin 17 at the lower portion of the ferrule. The screw or pin 17 may be configured to secure the blade or plurality of blades 14 and/or 15 to the ferrule 13. In some configurations, the broadhead 5 may include at least one or two upper screw/pins 17. In some examples, the second or lower screw/pin may be configured as a port or hole to accept media to secure the mechanical blades 15 in a retracted position. As described above, the screw or pin 17 may be configured to secure the mechanical and/or fixed blade system to the ferrule and may be interchangeable between blades. In certain examples, the blades 14 and/or 15 and/or 16 may include vents 19. In some examples, the blades 14 and/or 15 and/or 16 may not include vents 19. In still other examples, each blade 14 and/or 15 and/or 16 may include a plurality of vents 19. Vents 19 may be substantially triangular shaped. In other examples, vents 19 may be substantially shaped like a square, circle, rectangle, polygon, parallelogram, star, etc. Again, the user may remove the first pin or screw 17 of the broadhead 3 with a common tool and the mechanical and or fixed blades 15 may be removed and/or secured to the ferrule 13. The aft portion of the ferrule 13 may include a lower threaded portion 18 and may be adapted to attach to an arrow shaft. In alternative embodiments, the lower portion 18 may or may not include threads and may be attached to an arrow or cross-bow bolt by other means known to one of skill in the art, such as an adhesive, friction fit, screw; or bolt and nut, etc.

FIG. 9 also illustrates a side perspective-view of the mechanical broadhead 5. Upon target impact, the mechanical blade or blades 15 of broadhead 5 may be configured to deploy to an extended position. In some configurations, the mechanical blades 15 may rotate about the axis of the first or upper screw/pin 17 as shown in FIG. 9. The blades 15 and 16 as shown in FIGS. 9 and 11, and blades 14 and 16 as shown in FIGS. 10 and 12 may be oriented at a 90 degree angle between each blade. The blades 14 and 15 of broadhead 5, as shown in FIGS. 12 and 11, may include an angle that may form at least a 10, 15, 20, 25, 30, 35, 40, 45, 50, 55, 60, 65, 70, 75, 80, 85, or 90 degree angle as measured from the longitudinal axis of the ferrule and arrow shaft when in the deployed or extended positions.

In another example, the blades 14 and 15 of the broadhead 5 may form an angle in the deployed or open position of about 90 to 120 degrees when the blades are extended in the deployed position as measured from the longitudinal axis of the ferrule 13 and arrow shaft to the tips of the blades 14 and 15. In some examples, the angle of the blades 14 and 15 may form a 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, or 180 degree angle as measured from the longitudinal axis of the ferrule 13 and arrow shaft when in the deployed or extended position.

In some examples, the blades 15 and/or ferrules 13 may be constructed of 7075 aircraft aluminum, 416 hardened stainless steel, or titanium ceramic, steel, carbon, or combinations thereof. In other examples, ferrule 13 may be formed of any suitable material such as steel, titanium, composite, plastic, alloy, carbon fiber, etc.

Variations and modifications of the foregoing are within the scope of the present invention. For example, one of skill in the art will understand that multiples of the described components may be used in stores and in various configurations. The present invention is therefore not to be limited to a single system, nor the upright pusher configuration, depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. This disclosure is described to cover any and all modifications and forms which may come within the language and scope of the appended claims.

What is claimed is:

1. A multifunctional broadhead comprising:

a ferrule comprising a slot, wherein the slot is configured to interchangeably house a first blade configured to operate in a first mode wherein the first blade extends through the slot across a width of the ferrule, and a second blade and a third blade configured to operate in a second mode, wherein the slot comprises an opening sized to house a thickness of both the second blade and the third blade;

wherein a screw/pin secures the second and third blades to each other, wherein the second and third blades are held in a retracted position by insertion of a media into the second and third blades forming a friction fit, wherein upon target impact the second and third blades deploy into an extended position, and wherein the first and second modes are user selected.

2. The multifunctional broadhead of claim 1, wherein the media is a polymer.

3. The multifunctional broadhead of claim 1, wherein the media is a metal.

4. The multifunctional broadhead of claim 3, wherein the media is a spring.

5. The multifunctional broadhead of claim 1, wherein the first blade is interchangeable with the second blade or the third blade.

6. The multifunctional broadhead of claim 1, wherein the first blade is interchangeable with the second blade and the third blade.

7. The multifunctional broadhead of claim 1, wherein tips of the second and third blades bend away from the ferrule in the retracted position.

8. The multifunctional broadhead of claim 1, wherein the slot is configured to accommodate the screw/pin that secures the second and third blades to each other.

9. The multifunctional broadhead of claim 1, wherein the first blade consists of two blades secured together and operable to function in the first mode.

10. A multifunctional broadhead comprising:

a ferrule comprising at least one opening configured to interchangeably house a first blade and a pair of blades;

wherein the first blade configured to engage the ferrule and configured to operate in a first mode, wherein the first mode is a fixed blade configuration wherein the first blade extends through the opening and across a width the ferrule; and wherein the pair of blades interchangeable with the first blade and configured to engage the ferrule and configured operate in a second mode, wherein the second mode is a mechanical configuration, wherein the pair of blades are held in a retracted position by a media forming a friction fit in the pair of blades throughout an arrow time of flight, and wherein the pair of blades deploy to an extended position upon a target impact.

11. The multifunctional broadhead of claim 10, wherein the media is a polymer.

12. The multifunctional broadhead of claim 10, wherein the media is a metal.

13. The multifunctional broadhead of claim 12, wherein the media is a spring.

14. The multifunctional broadhead of claim 10, wherein tips of the pair of blades bend away from the ferrule in the retracted position.

15. The multifunctional broadhead of claim 14, wherein the tips of the pair of blades assist the blades in deploying to the extended position upon the target impact.

16. The multifunctional broadhead of claim 15, wherein each blade of the pair of blades form an angle in the extended position of about 90 to 120 degrees measured from a longitudinal axis of the ferrule and an arrow shaft to the tip of the blade.

17. A broadhead system comprising:

a ferrule comprising a slot extending across an entire width of the ferrule; and a pair of blades configured to removably engage the ferrule and configured to operate in a mechanical mode, wherein the pair of blades are held in a retracted position by insertion of a media comprising a polymer or a metal into the pair blades, and wherein the pair of blades deploy through the slot into an extended position upon impacting a target, and wherein the pair of blades are interchangeable with a fixed blade, and wherein the fixed blade is configured to removably engage the ferrule.

18. The broadhead system of claim 17, wherein the fixed blade consists of two blades secured together and extends through an entire width of the slot.

19. The broadhead system of claim 18, wherein the pair of blades are interchangeable with the fixed blade.

20. The broadhead system of claim 17, wherein the media is a polymer, a metal, or a spring.

21. A multifunctional broadhead comprising:

a ferrule comprising a passageway extending across a full width of the ferrule and configured to interchangeably house a first blade configured to operate in a first mode, and a second blade and a third blade configured to operate in a second mode, wherein the passageway comprises a size configured to house a thickness of both the second blade and the third blade, wherein the second and third blades replace the first blade in the second mode, wherein a screw/pin secures the second and third blades to each other, wherein the second and third blades are held in a retracted position by insertion of a media into the second and third blades and wherein upon a target impact the second blade and the third blade deploy into an extended position, and wherein the first and second modes are user selected.

22. A broadhead comprising:

a ferrule configured to operate in a first mode and second mode, wherein the first mode is a fixed configuration and the second mode is a mechanical configuration;

the ferrule comprising a slot wherein the slot comprises a width extending across a width of the ferrule, wherein the slot is dimensioned to interchangeably house a first blade configured to operate in the first mode, and a second and a third blade configured to operate in the second mode;

wherein a screw/pin secures the second and third blades to each other, and wherein the slot is further dimensioned to accommodate the screw/pin that secures the second and third blades to each other;

wherein the second and third blades are configured to replace the first blade in the second mode;

wherein the second and third blades are held in a retracted position by insertion of a media into the second and third blades;

wherein upon target impact the second and third blades deploy into an extended position; and wherein a user can interchangeably select between the first and second modes.

* * * * *